US010730738B2

(12) United States Patent
Chernov et al.

(10) Patent No.: US 10,730,738 B2
(45) Date of Patent: Aug. 4, 2020

(54) REFRIGERATOR APPLIANCE WITH ACCELERATED DISPENSING

(71) Applicant: Haier US Appliance Solutions, Inc., Wilmington, DE (US)

(72) Inventors: Gregory Sergeevich Chernov, Lousiville, KY (US); Andrew Reinhard Krause, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 79 days.

(21) Appl. No.: 15/954,775

(22) Filed: Apr. 17, 2018

(65) Prior Publication Data

US 2019/0315617 A1 Oct. 17, 2019

(51) Int. Cl.
*B67D 7/02* (2010.01)
*F25D 23/12* (2006.01)

(52) U.S. Cl.
CPC ..... *B67D 7/0238* (2013.01); *F25D 23/126* (2013.01); *F25D 2323/121* (2013.01)

(58) Field of Classification Search
CPC ..... B67D 7/0238; F25D 23/126; F25D 2323/121; F25D 23/12
See application file for complete search history.

(56) References Cited

U.S. PATENT DOCUMENTS

| | | | | |
|---|---|---|---|---|
| 6,532,758 | B2 | 3/2003 | DuHack | |
| 9,677,802 | B2 | 6/2017 | Lee | |
| 2005/0268639 | A1* | 12/2005 | Hortin | B67D 1/0009 62/389 |
| 2008/0197077 | A1* | 8/2008 | Swartley | B01D 61/145 210/650 |
| 2015/0315009 | A1* | 11/2015 | Cur | B67D 1/10 62/331 |
| 2017/0057803 | A1* | 3/2017 | McKinney | F25D 23/12 |
| 2019/0093942 | A1* | 3/2019 | Scalf | F25D 23/126 |

* cited by examiner

*Primary Examiner* — Elizabeth J Martin
(74) *Attorney, Agent, or Firm* — Dority & Manning, P.A.

(57) ABSTRACT

A refrigerator appliance includes a water supply system with a supply conduit connectable to a pressurized water supply such that a flow of water is flowable through the supply conduit to an exit of the supply conduit positioned at a dispenser recess. A dispensing valve is coupled to the supply conduit downstream of a flow restriction. A water tank is connected to the supply conduit downstream of the flow restriction and upstream of the dispensing valve. The water tank is configured such that a compressible medium within the water tank is compressed by water from the supply conduit when the dispensing valve is closed.

17 Claims, 5 Drawing Sheets

REFRIGERATOR APPLIANCE WITH ACCELERATED DISPENSING

FIELD OF THE INVENTION

The present subject matter relates generally to refrigerator appliances with water dispensers.

BACKGROUND OF THE INVENTION

Refrigerator appliances generally include a cabinet that defines one or more chambers for the receipt of food items for storage. Certain refrigerator appliances also include features for dispensing ice and/or liquid water. To provide ice and/or liquid water, a dispenser is typically positioned on a door of the appliance. The user positions a container proximate the dispenser, and ice and/or liquid water are deposited into the container depending upon the user's selection. A paddle or other type switch may be provided whereby the user may make a selection.

Various components with refrigerator appliances can reduce the pressure of water flowing between a wall connection and the dispenser. For example, refrigerator appliances can include water filters, solenoid valves, pressure regulators, etc., and such components can generate a pressure drop that disadvantageously reduces the flow rate of water at the dispenser. Thus, filling a container at the dispenser may take an inconvenient amount of time.

Water filters are frequently the largest flow restrictor within refrigerator appliances and can generate a significant pressure drop. However, the contaminant reduction performance of a water filter is certified at a specific service flow rate, typically a half-gallon per minute for refrigerator water filters. Operation of refrigerator water filters at flowrates above the specific service flow rate is unacceptable as such actions will void contaminant reduction claims. A water filter can be recertified to a new flow rate but the performance of the water filter can be significantly reduced.

BRIEF DESCRIPTION OF THE INVENTION

Aspects and advantages of the invention will be set forth in part in the following description, or may be apparent from the description, or may be learned through practice of the invention.

In a first example embodiment, a refrigerator appliance includes a cabinet that defines a chilled chamber. A door is mounted to the cabinet such that the door provides selective access to the chilled chamber of the cabinet. The door defines a dispenser recess. A water supply system includes a supply conduit connectable to a pressurized water supply such that a flow of water is flowable through the supply conduit to an exit of the supply conduit positioned at the dispenser recess on the door. A flow restriction is coupled to the supply conduit. A dispensing valve is coupled to the supply conduit downstream of the flow restriction. A supply conduit branch extends from the supply conduit. The supply conduit branch is positioned downstream of the flow restriction and upstream of the dispensing valve. A water tank is connected to the supply conduit branch. The water tank is at least partially filled with air. The water tank is configured such that air within the water tank is compressed by water from the supply conduit when the dispensing valve is closed.

In a second example embodiment, a refrigerator appliance includes a cabinet that defines a chilled chamber. A water supply system includes a supply conduit connectable to a pressurized water supply such that a flow of water is flowable through the supply conduit to an exit of the supply conduit positioned at a dispenser. A water filter is coupled to the supply conduit. A dispensing valve is coupled to the supply conduit downstream of the water filter. A water tank is connected to the supply conduit downstream of the water filter and upstream of the dispensing valve. The water tank is at least partially filled with a compressible medium. The water tank is configured such that the compressible medium within the water tank is compressed by water from the supply conduit when the dispensing valve is closed.

In a third example embodiment, a water dispensing system includes a supply conduit connectable to a pressurized water supply such that a flow of water is flowable through the supply conduit to an exit of the supply conduit. A water filter is coupled to the supply conduit. A dispensing valve is coupled to the supply conduit downstream of the water filter. A water tank is connected to the supply conduit downstream of the water filter and upstream of the dispensing valve. The water tank is at least partially filled with a compressible medium. The water tank is configured such that the compressible medium within the water tank is compressed by water from the supply conduit when the dispensing valve is closed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
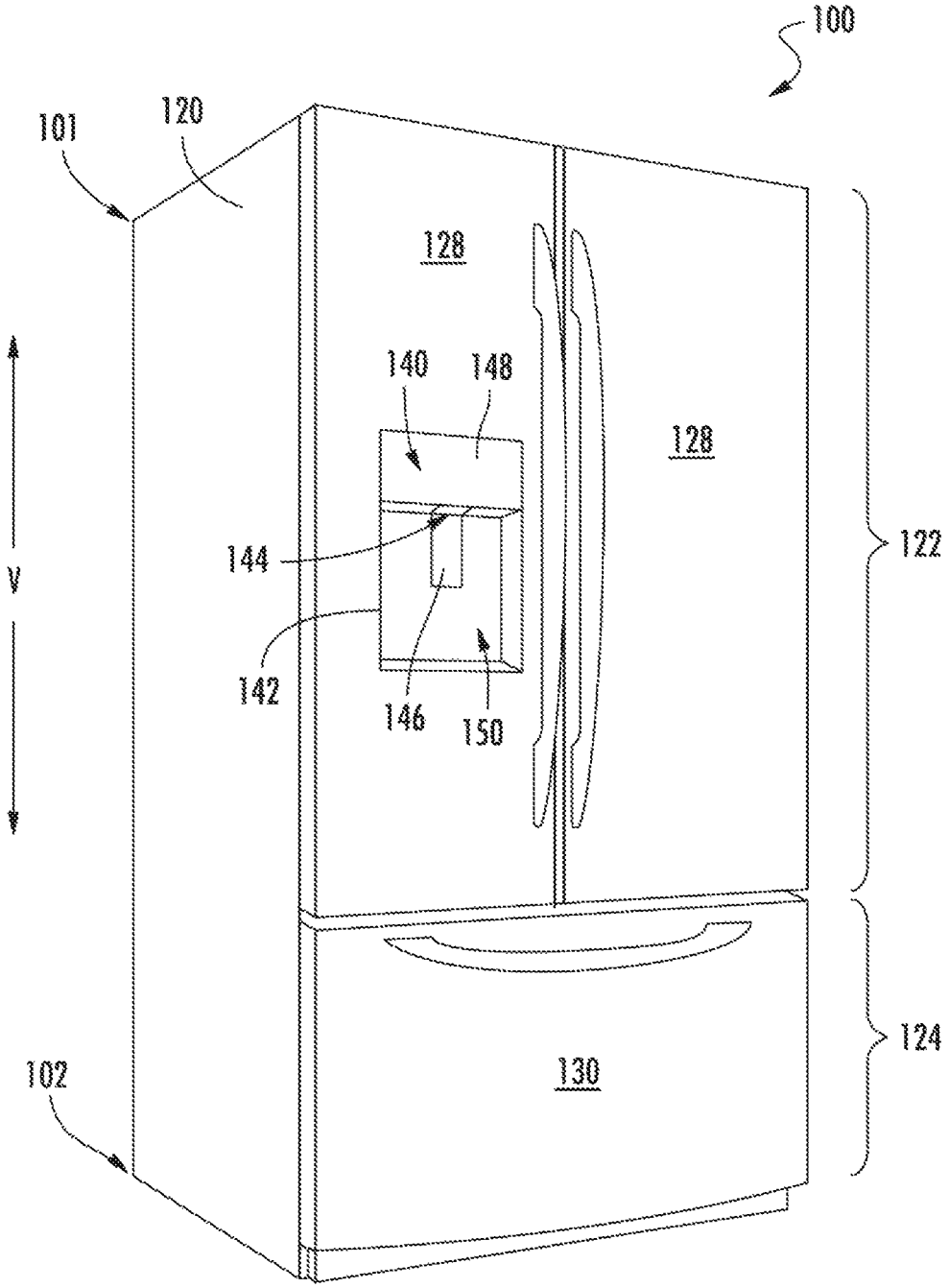
FIG. 1 is a perspective view of a refrigerator appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a refrigerator appliance 100 according to an example embodiment of the present subject matter. Refrigerator appliance 100 includes a cabinet or housing 120 that extends between a top 101 and a bottom 102 along a vertical direction V. Housing 120 defines chilled chambers for receipt of food items for storage. In particular, housing 120 defines fresh food chamber 122 positioned at or adjacent top 101 of housing 120 and a freezer chamber 124 arranged at or adjacent bottom 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, a standalone ice-maker appliance, or a water/beverage dispensing appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 120. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 120. In the exemplary embodiment, dispenser recess 150 is positioned at a level that approximates the chest level of a user.

Figure 2:
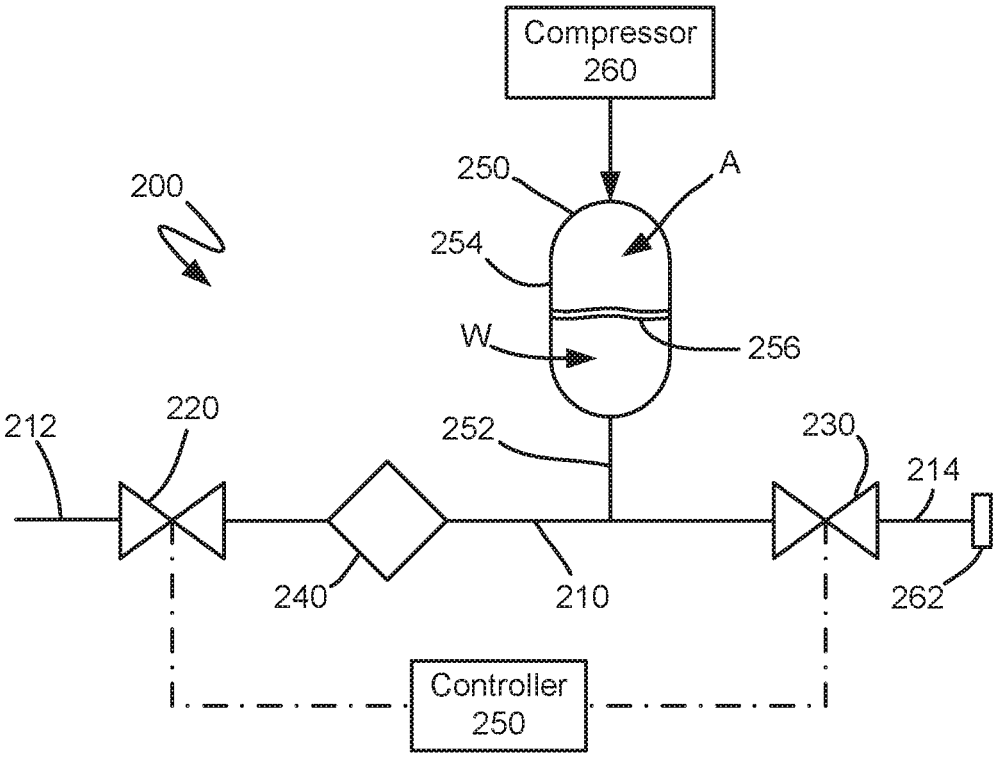
FIG. 2 is a schematic view of a water dispensing system of the example refrigerator appliance of FIG. 1.

FIG. 2 is a schematic view of a water dispensing system 200. Water dispensing system 200 may be utilized in refrigerator appliance 100 to supply water to discharging outlet 144 and dispenser recess 150. Thus, water dispensing system 200 is described in greater detail below in the context of refrigerator appliance 100. It will be understood that water dispensing system 200 may also be utilized in other appliances, such as other refrigerator appliance configurations. As another example, water dispensing system 200 may be utilized with a point-of-use water filter. As discussed in greater detail below, water dispensing system 200 includes features for dispensing water at an accelerated rate relative to water dispensing systems in known refrigerator appliances.

As may be seen in FIG. 2, water dispensing system 200 includes a supply conduit 210. Supply conduit 210 is connectable to a pressurized water supply, such as a municipal water supply or well, e.g., at an inlet section 212 of supply conduit 210. In particular, inlet section 212 of supply conduit 210 may be threaded to a plumbing tap within a building. An outlet section 214 of supply conduit 210 may be positioned at or adjacent dispenser recess 150, e.g., above dispenser recess 150. Water is flowable through supply conduit 210 from inlet section 212 to outlet section 214 of supply conduit 210. Thus, water is flowable from the pressurized water supply to dispenser 142 through supply conduit 210.

Water dispensing system 200 can also include an isolation valve 220 and a dispensing valve 230. Isolation valve 220 and dispensing valve 230 are both coupled to supply conduit 210 and are operable to regulate the flow of water through supply conduit 210. For example, isolation valve 220 and dispensing valve 230 may be closed to stop the flow of water through supply conduit 210. Conversely, isolation valve 220 and dispensing valve 230 may be opened to permit the flow of water through supply conduit 210.

Isolation valve 220 may be positioned upstream of dispensing valve 230 on supply conduit 210. For example, isolation valve 220 may be positioned at or proximate inlet section 212 of supply conduit 210. Conversely, dispensing valve 230 may be positioned at or proximate outlet section 214 of supply conduit 210. Isolation valve 220 may be closed to terminate water flow through all components of water dispensing system 200 that are downstream of isolation valve 220. Thus, e.g., isolation valve 220 may be closed during servicing of water dispensing system 200, changing of a water filter, etc. to prevent spilling of water from the water dispensing system 200. 6. Isolation valve 220 may also protect components of water dispensing system 200 from pressure variations in the pressurized water supply when water dispensing system 200 is idle. Dispensing valve 230 may be opened to permit water flow to dispenser 142. Thus, dispensing valve 230 may be open and closed to regulate water flow to dispenser 142 and/or a container within dispenser recess 150.

Water dispensing system 200 further includes a controller 250. Controller 250 regulates operation of water dispensing system 200. Thus, controller 250 is in operative communication with various components of water dispensing system 200, such as isolation valve 220 and dispensing valve 230. In particular, controller 250 may selectively open and close isolation valve 220 and dispensing valve 230 in order to regulate fluid flow through supply conduit 210.

Controller 250 includes memory and one or more processing devices such as microprocessors, CPUs or the like, such as general or special purpose microprocessors operable to execute programming instructions or micro-control code associated with operation of water dispensing system 200. The memory can represent random access memory such as DRAM, or read only memory such as ROM or FLASH. The processor executes programming instructions stored in the memory. The memory can be a separate component from the processor or can be included onboard within the processor. Alternatively, controller 250 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Various components of water dispensing system 200 are coupled to supply conduit 210 such that water within supply conduit 210 flows through and/or into such components. For example, supply conduit 210 includes one or more flow restrictions 240 coupled to supply conduit 210. Flow restrictions 240 generate a pressure drop within the water flowing through supply conduit 210. Flow restrictions 240 may include one or more of a water filter, a solenoid valve, a flow control washer, etc. It will be understood that water filter may include a filter cartridge removably mounted to a manifold, and the filter cartridge may include a filter medium, such as a carbon filter block, a pleated cellulose filter, a ceramic filter, etc. Dispensing valve 230 is coupled to supply conduit 210 downstream of flow restrictions 240. Thus, e.g., flow restrictions 240 generate a pressure drop within the water flowing through supply conduit 210 to dispenser 142 when dispensing valve 230 is open.

As noted above, water dispensing system 200 includes features for dispensing water at an accelerated rate relative to water dispensing systems in known refrigerator appliances. In particular, water dispensing system 200 includes a water tank 250 connected to a supply conduit branch 252. In certain example embodiments, water tank 250 may be a cold water tank. Thus, water tank 250 may be positioned at or within fresh food chamber 122 such that water within water tank 250 is cooled to the temperature of fresh food chamber 122.

Supply conduit branch 252 extends from supply conduit 250 and is positioned downstream of flow restrictions 240 and upstream of dispensing valve 230. Thus, after passing through flow restrictions 240, water within supply conduit 210 may pass by water tank 250 and supply conduit branch 252 prior to flowing to dispenser 142 when dispensing valve 230 is open. As may be seen from the above, water tank 250 may not be connected on supply conduit 210 in series between flow restrictions 240 and dispensing valve 230. Rather, supply conduit branch 252 may split from supply conduit 210 between flow restrictions 240 and dispensing valve 230, and water tank 250 may form a dead end off of supply conduit 210.

Water from supply conduit 210 is flowable through supply conduit branch 252 into water tank 250. In particular, water tank 250 is at least partially filled with air, and the air within water tank 250 is compressible by the water from supply conduit 210 that flows into water tank 250 through supply conduit branch 252. Operation of water dispensing system 200, in particular water tank 250, is described in greater detail below in the context of FIGS. 3 through 6.

FIGS. 3 through 6 are schematic views of water dispensing system 200 in various operating states. In particular, water dispensing system 200 is shown in a charged operating state in FIG. 3. Water dispensing system 200 is shown in an accelerated dispense operating state in FIG. 4 and in a depleted acceleration dispense operating state in FIG. 5. Water dispensing system 200 is shown in a charging operating state in FIG. 6.

In FIGS. 3 through 6, the volumes of water and compressed air within water tank 250 changes. The volume of water within water tank 250 is shown with cross-hatch fill while the volume of compressed air within water tank 250 is shown with solid white fill in FIGS. 3 through 6. In addition, dispensing valve 230 is shown with solid black fill when dispensing valve 230 is closed in FIGS. 3 through 6, and dispensing valve 230 is shown with solid white fill when dispensing valve 230 is open in FIGS. 3 through 6.

Figure 3:
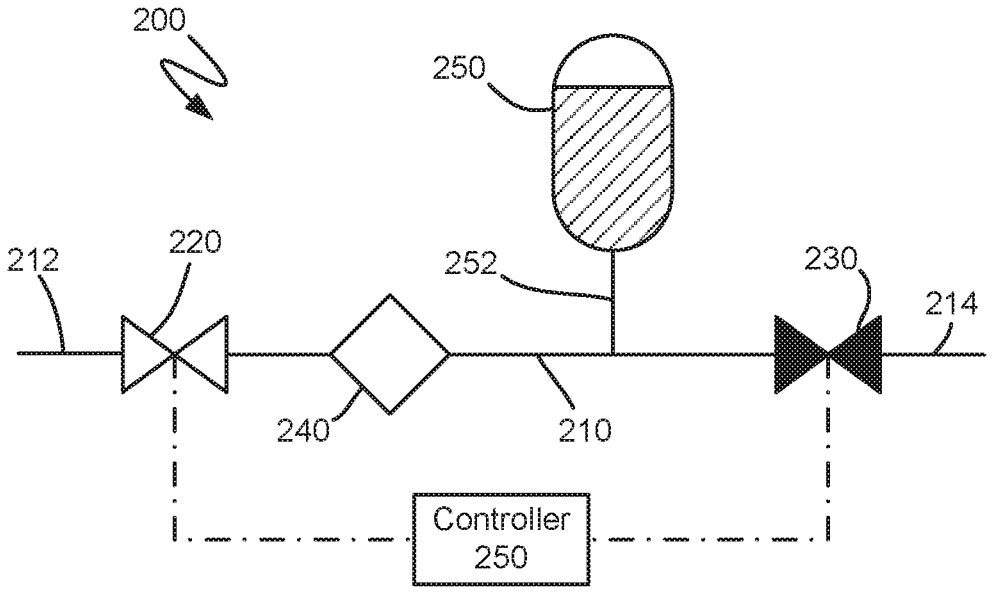
FIGS. 3 through 6 are schematic views of the water dispensing system of FIG. 2 in various operating states.

As shown in FIG. 3, dispensing valve 230 is closed in the charged operating state. In addition, water dispensing system 200 is static in the charged operating state such that there is not water flow through supply conduit 210. With dispensing valve 230 closed and no water flow through supply conduit 210, air is compressed within water tank 250. The air within water tank 250 may be compressed by the water from supply conduit 210 via supply conduit branch 252. In particular, the pressure of the air within water tank 250 may be equal to the pressure of water within supply conduit 210 (e.g., at inlet section 212 of supply conduit 210) in the charged operating state. Thus, water tank 250 may contain a volume of pressurized water and air in the charged operating state. A pressure of the air in water tank 250 may be maximized in the charged operating state relative to the other operating states of water dispensing system 100. It will be understood that isolation valve 220 may be closed when water dispensing system 200 is in the charged operating state.

When water dispensing system 100 is in the charged operating state, a user may request water at dispenser 142 with actuating mechanism 146. In response, controller 250 may open dispensing valve 230, e.g., and isolation valve 220. In such a manner, water dispensing system 200 may be shifted from the charged operating state in FIG. 3 to the accelerated dispense operating state in FIG. 4. When dispensing valve 230 is opened, the compressed air in water tank 250 expands and urges the water within water tank 250 through supply conduit branch 252 and towards dispenser 142.

Eventually the compressed air within in water tank 250 expands until the pressure of the air within water tank 250 is equal to the pressure of the water flowing through supply conduit 210 immediately downstream of flow restrictions 240. Thus, the charge of air within water tank 250 may be exhausted, and water dispensing system 200 shifts to the depleted acceleration dispense operating state in FIG. 5.

In the depleted acceleration dispense operating state, water does not flow from water tank 250 into supply conduit 210 through supply conduit branch 252 due to the equalized pressure between the air in tank and the water within supply conduit 210. However, water continues to flow to dispenser 142 in the depleted acceleration dispense operating state. In particular, water from inlet section 212 of supply conduit 210 flows through flow restrictions 240 to dispenser 142 in the depleted acceleration dispense operating state. The pressure of the air in water tank 250 may be minimized in the depleted acceleration dispense operating state relative to the other operating states of water dispensing system 100.

Figure 4:
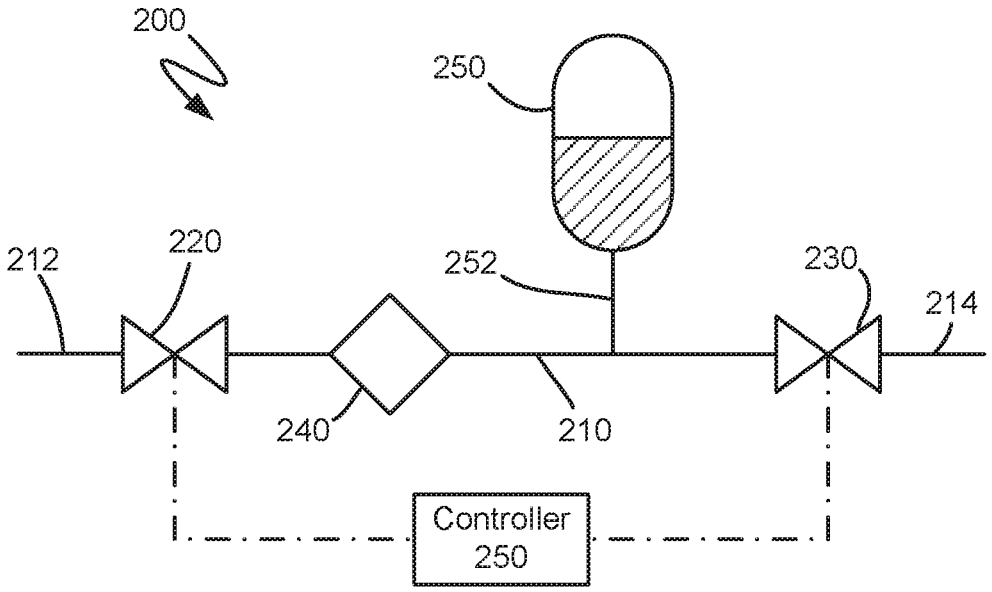

As noted above, water tank 250 is positioned downstream of flow restrictions 240. Thus, the water from water tank 250 may flow to dispenser 142 without passing through flow restrictions 240 and without the pressure drop associated with flowing through flow restrictions 240 in the accelerated dispense operating state. Conversely, water from inlet section 212 of supply conduit 210 flows through flow restrictions 240 to dispenser 142 in the depleted acceleration dispense operating state. Since the flow resistance through supply conduit 210 between water tank 250 and outlet section 214 of supply conduit 210 is significantly less the flow resistance through flow restrictions 240, the dispense rate of water dispensing system 200 in the accelerated dispense operating state shown in FIG. 4 is significantly greater than in the depleted acceleration dispense operating state shown in FIG. 5. For example, the dispense rate of water dispensing system 200 in the accelerated dispense operating state may be no less than three times the dispense rate of water dispensing system 100 in the depleted acceleration dispense operating state.

Figure 6:
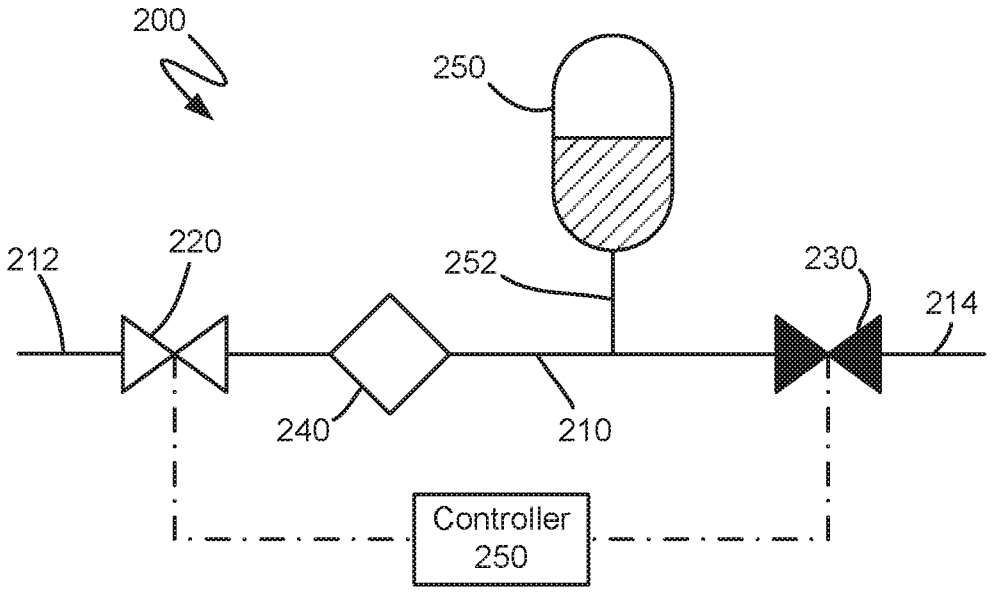

After dispensing water in the accelerated dispense operating state, water dispensing system 200 may shift to the charging operating state shown in FIG. 6 by closing dispensing valve 230. Thus, from either the accelerated dispense operating state or the depleted acceleration dispense operating state, controller 250 may close dispensing valve 230 to terminate water flow to dispenser 142 and start recharging water tank 250. In the charging operating state, air within water tank 250 is compressed by water from supply conduit 210. In particular, after closing dispensing valve 230, the water in supply conduit 210 approaches the pressure of water at inlet section 212 of supply conduit 210, i.e., upstream of flow restrictions 240. The increasing pressure in supply conduit 210 causes water from supply conduit 210 to flow into water tank 250 via supply conduit branch 252.

Eventually the pressure of water within supply conduit 210 stabilizes at the pressure of water at inlet section 212 of supply conduit 210, and water stops flowing into water tank 250 from supply conduit 210. Thus, water dispensing system 200 shifts from the charging operating state shown in FIG. 6 to the charged operating state shown in FIG. 3 when water stops flowing into water tank 250 due to the equalization of pressure between supply conduit 210 and water tank 250. Isolation valve 220 may be closed once water dispensing system 200 shifts from the charging operating state to the charged operating state shown.

Figure 5:
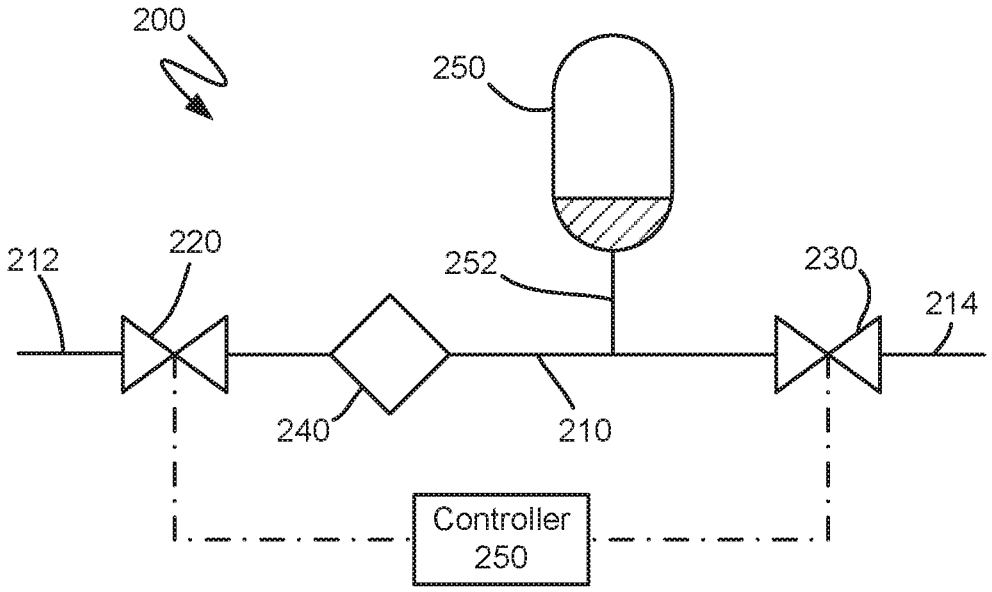

As noted above, the dispense rate of water dispensing system 200 in the accelerated dispense operating state shown in FIG. 4 is significantly greater than in the depleted acceleration dispense operating state shown in FIG. 5. It will be understood that the depleted acceleration dispense operating state shown in FIG. 5 generally corresponds to the dispense rate without the benefit of water tank 250. As an example, water tank 250 may be configured such that a maximum flow rate of the water from water tank 250, and thus at the exit of supply conduit 210, is no less than two gallons per minute (2 gal/min) in the accelerated dispense operating state. Conversely, in the depleted acceleration dispense operating state, the maximum flow rate of the water at the exit of supply conduit 210 may be about a half-gallon per minute (0.5 gal/min). As may be seen from the above, the flow rate of the water at the exit of supply conduit 210 may be advantageously increased by providing water tank 250 downstream of flow restrictions 240 and upstream of dispensing valve 230.

Various constructions of water tank 250 are available to include compressible air within water tank 250. For example, water tank 250 may be a simple closed tank at least partially filled with air such that there is direct contact between the air and water within water tank 250. Water dispensing system 200 may include a compressor 260 in certain example embodiments. Compressor 260 is operable to flow compressed air into water tank 250. The air from compressor 260 may be particularly useful to replace air within water tank 250 that diffuses into the water within water tank 250 when there is direct contact between the air and water within water tank 250. In alternative example embodiments, water tank 250 may be a bladder tank or a diaphragm tank, e.g., such that there is no direct contact between the air and water within water tank 250. Compressor 260 may be useful to replace air that leaks from water tank 250 in such example embodiments.

Water tank 250 may include a one-way valve (not shown) at top of water tank 250 in certain example embodiments. The one-way valve can allow air to enter water tank 250 when if the amount of air had depleted due to absorption by water within water tank 250. A periodic maintenance routine may be utilized to drain water tank 250 and to allow air to reenter water tank 250 via the one-way valve.

In certain example embodiments, water tank 250 may be made of an elastic material, such as rubber or silicone. The elastic walls of water tank 250 allow expansion when water within water tank 250 is pressurized, e.g., during the charging operating state, while also allowing retraction when water within water tank 250 depressurizes, e.g., during the accelerated dispense operating state. When water tank 250 has elastic walls, water tank 250 need not include air within water tank 250.

It will be understood that an alternative compressible media may be used instead of air, e.g., carbon dioxide or some other gas. Thus, water tank 250 may be connected to a pressurized gas tank to charge water tank 250. As another example, a spring or some other elastic member may be charged by water within water tank 250 in the charged operating state instead of air.

As may be seen in FIG. 2, water tank 250 may include a closed shell 254 and an elastic membrane 256. Elastic membrane 256 is disposed within closed shell 254, e.g., such that elastic membrane 256 is deformable by water flowing into closed shell 254. Elastic membrane 256 is positioned between the air A and the water W within closed shell 254. Water tank 250 may include a rigid divider (not shown) between the air A and the water W in alternative example embodiments. One or more seals may extend between the water tank 250 and the rigid divider to reduce or eliminate contact between the air A and the water W.

Water tank 250 may be sized for use within refrigerator appliance 100. For example, water tank 250 may be sized to contain no less than one liter and no more than two liters of water, e.g., in the charged operating state. Thus, water tank 250 may advantageously contain enough water to fill common drinking containers while not occupying excessive space within refrigerator appliance 100. Water supply system 200 may further include an aerator, screen or specially designed dispense nozzle 262 mounted to supply conduit 210 at outlet section 214 of supply conduit 210. Aerator 262 assists with softly flowing water into a container within dispenser recess 150 despite the increased flow rate associated with the accelerated dispense operating state.

Controller 250 may also operate isolation valve 220 to facilitate operation of water dispensing system 200 in the accelerated dispense operating state. For example, controller 250 may close isolation valve 220 after a specific time delay (e.g., five seconds) to terminate water flow through supply conduit 210 and avoid overfilling a container within dispenser recess 150. Isolation valve 220 may also be adjustable to positions between fully open and fully closed to allow adjustment of the flow rate at the exit of supply conduit 210 in the accelerated dispense operating state. For example, controller 250 may adjust isolation valve 220 to change (i.e., increase or decrease) the pressure of water within supply conduit 210 downstream of isolation valve 220 in the accelerated dispense operating state. A pressure sensor (not shown) may be utilized to improve control over the "charge" and the magnitude of the flow rate. In such a manner, controller 250 may use isolation valve 220 to adjust the flow rate at the exit of supply conduit 210 in the accelerated dispense operating state.

Figure 7:
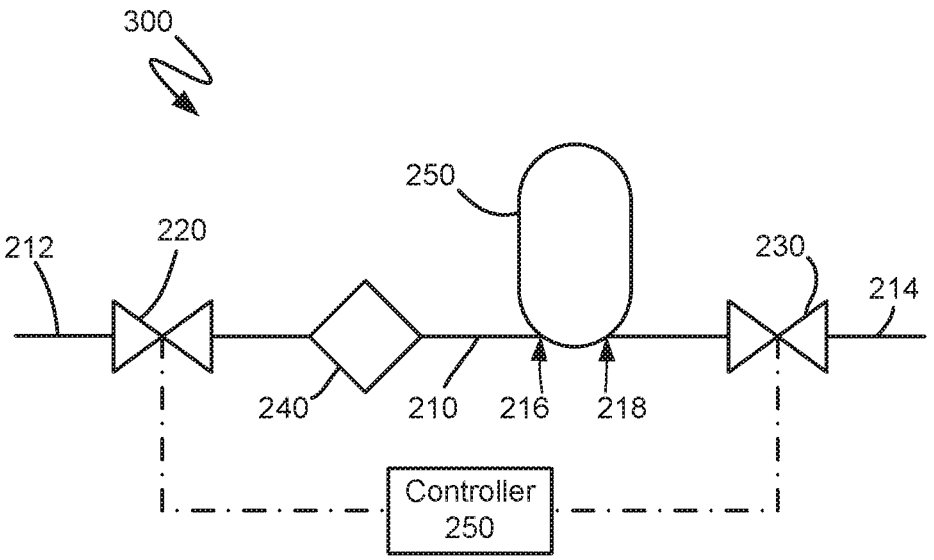
FIG. 7 is a schematic view of the water dispensing system of FIG. 2 according to another example embodiment of the present subject matter.
Figure 8:
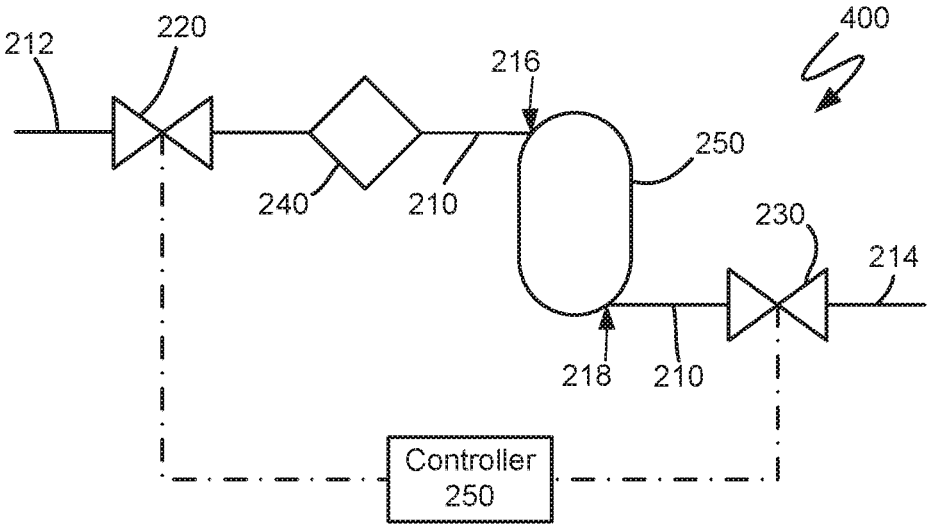
FIG. 8 is a schematic view of the water dispensing system of FIG. 2 according to an additional example embodiment of the present subject matter.

FIG. 7 is a schematic view of a water dispensing system 300 according to another example embodiment of the present subject matter. FIG. 8 is a schematic view of a water dispensing system 400 according to an additional example embodiment of the present subject matter. As shown in FIGS. 7 and 8, water dispensing systems 300, 400 includes numerous common components with water dispensing system 200. Thus, the description of water dispensing system 200 provided above is applicable to dispensing systems 300, 400 except as otherwise noted.

As may be seen in FIG. 7, water dispensing system 300 does not include supply conduit branch 252. Rather, water tank 250 is coupled to supply conduit 210 such that an inlet 216 and an outlet 218 of supply conduit 210 are positioned at a bottom portion of water tank 250. Thus, water from supply conduit 210 enters water tank 250 at the bottom portion of water tank 250 via inlet 216, and water exits water tank 250 into supply conduit 210 at the bottom portion of water tank 250 via outlet 218. Such positioning of the inlet and an outlet of supply conduit 210 allows water from supply conduit 210 to flow into water tank 250 and charge air within water tank 250 in the manner described above. However, water tank 250 is not positioned on a branch from supply conduit 210 in water dispensing system 300. Rather, water tank 250 is mounted in-line with supply conduit 210 in water dispensing system 300.

Turning now to FIG. 8, water dispensing system 400 also does not include supply conduit branch 252. Rather, water tank 250 is coupled to supply conduit 210 such that outlet 218 of supply conduit 210 is positioned at the bottom portion of water tank 250 while inlet 216 of supply conduit 210 is positioned at a top portion of water tank 250. Thus, water from supply conduit 210 enters water tank 250 at the top portion of water tank 250 via inlet 216, and water exits water tank 250 into supply conduit 210 at the bottom portion of water tank 250 via outlet 218. Such positioning of the inlet and an outlet of supply conduit 210 allows water from supply conduit 210 to flow into water tank 250 and charge air within water tank 250 in the manner described above. However, water tank 250 is not positioned on a branch from supply conduit 210 in water dispensing system 300. Rather, water tank 250 is mounted in-line with supply conduit 210 in water dispensing system 300.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:
- a cabinet defining a chilled chamber;
- a door mounted to the cabinet such that the door provides selective access to the chilled chamber of the cabinet, the door defining a dispenser recess; and
- a water supply system comprising
  - a supply conduit connectable to a pressurized water supply such that a flow of water is flowable through the supply conduit to an exit of the supply conduit positioned at the dispenser recess on the door;
  - a flow restriction coupled to the supply conduit;
  - a dispensing valve coupled to the supply conduit downstream of the flow restriction;
  - a controller in operative communication with the dispensing valve, the controller configured for opening the dispensing valve in response to a signal from an actuating mechanism in the dispenser recess;
  - a supply conduit branch extending from the supply conduit, the supply conduit branch positioned downstream of the flow restriction and upstream of the dispensing valve; and
  - a water tank connected to the supply conduit branch, the water tank at least partially filled with air, the water tank configured such that air within the water tank is compressed by water from the supply conduit when the dispensing valve is closed,
- wherein the flow restriction comprises a water filter positioned upstream of the supply conduit branch.

2. The refrigerator appliance of claim 1, further comprising a compressor connected to the water tank such that the compressor is operable to flow compressed air into the water tank.

3. The refrigerator appliance of claim 1, wherein the water tank is a bladder tank or a diaphragm tank.

4. The refrigerator appliance of claim 1, wherein the water tank comprises a closed shell and an elastic membrane disposed within the closed shell, the elastic membrane configured such that the elastic membrane is positioned between the air and the water within the closed shell.

5. The refrigerator appliance of claim 1, wherein water from the water tank flows from the water tank to the exit of the supply conduit when the controller opens the dispensing valve.

6. The refrigerator appliance of claim 5, wherein a maximum flow rate of the water from the water tank is no less than two gallons per minute after the controller opens the dispensing valve.

7. The refrigerator appliance of claim 1, wherein the water tank is sized to contain no less than one liter and no more than two liters of water from the supply conduit when the dispensing valve is closed.

8. The refrigerator appliance of claim 1, wherein the water supply system further comprises an aerator mounted to the supply conduit at the exit of the supply conduit.

9. A refrigerator appliance, comprising:
- a cabinet defining a chilled chamber; and
- a water supply system comprising
  - a supply conduit connectable to a pressurized water supply such that a flow of water is flowable through the supply conduit to an exit of the supply conduit positioned at a dispenser;
  - a water filter coupled to the supply conduit;
  - a dispensing valve coupled to the supply conduit downstream of the water filter;
  - a controller in operative communication with the dispensing valve, the controller configured for opening the dispensing valve in response to a signal from an actuating mechanism in the dispenser recess; and
  - a water tank connected to the supply conduit downstream of the water filter and upstream of the dispensing valve, the water tank at least partially filled with a compressible medium, the water tank configured such that the compressible medium within the water tank is compressed by water from the supply conduit when the dispensing valve is closed.

10. The refrigerator appliance of claim 9, further comprising a compressor connected to the water tank such that the compressor is operable to flow compressed air into the water tank.

11. The refrigerator appliance of claim 9, wherein the water tank is a bladder tank or a diaphragm tank.

12. The refrigerator appliance of claim 9, wherein water from the water tank flows from the water tank to the exit of the supply conduit when the controller opens the dispensing valve.

13. The refrigerator appliance of claim 12, wherein a maximum flow rate of the water from the water tank is no less than two gallons per minute after the controller opens the dispensing valve.

14. The refrigerator appliance of claim 9, wherein the water tank is sized to contain no less than one liter and no more than two liters of water from the supply conduit when the dispensing valve is closed.

15. A water dispensing system, comprising:

a supply conduit connectable to a pressurized water supply such that a flow of waters flowable through the supply conduit to an exit of the supply conduit;

a water filter coupled to the supply conduit;

a dispensing valve coupled to the supply conduit downstream of the water filter;

a controller in operative communication with the dispensing valve, the controller configured for opening the dispensing valve in response to a signal from an actuating mechanism in the dispenser recess; and a water tank connected to the supply conduit downstream of the water filter and upstream of the dispensing valve, the water tank at least partially filled with a compressible medium, the water tank configured such that the compressible medium within the water tank is compressed by water from the supply conduit when the dispensing valve is closed.

16. The water dispensing system of claim 15, wherein the water tank is a bladder tank or a diaphragm tank.

17. The water dispensing system of claim 15, wherein the water tank is sized to contain no less than one liter and no more than two liters of water from the supply conduit when the dispensing valve is closed.

* * * * *